US010398018B2

(12) United States Patent
Newsham

(10) Patent No.: US 10,398,018 B2
(45) Date of Patent: Aug. 27, 2019

(54) COUPLING CANCELLATION IN ELECTRON ACCELERATION SYSTEMS

(71) Applicant: FAR-TECH, INC., San Diego, CA (US)

(72) Inventor: David Newsham, San Diego, CA (US)

(73) Assignee: FAR-TECH, Inc., San Diego, CA (US)

( * ) Notice: Subject to any disclaimer, the term of this patent is extended or adjusted under 35 U.S.C. 154(b) by 0 days.

(21) Appl. No.: 15/691,685

(22) Filed: Aug. 30, 2017

(65) Prior Publication Data

US 2019/0069388 A1 Feb. 28, 2019

(51) Int. Cl.

| | |
|---|---|
| ***H05B 7/06*** | (2006.01) |
| ***H05H 7/22*** | (2006.01) |
| ***H05H 9/04*** | (2006.01) |
| ***H01J 3/02*** | (2006.01) |

(52) U.S. Cl.

CPC ..... *H05H 7/22* (2013.01); *H01J 3/02* (2013.01); *H05H 9/04* (2013.01); *H05H 2007/225* (2013.01)

(58) Field of Classification Search

CPC ..... H05H 2007/225

See application file for complete search history.

(56) References Cited

U.S. PATENT DOCUMENTS

| | | | | |
|---|---|---|---|---|
| 4,122,373 | A * | 10/1978 | Vaguine | H01J 23/24 315/39.53 |
| 4,639,641 | A * | 1/1987 | Tronc | H05H 7/18 315/5.41 |
| 5,381,072 | A * | 1/1995 | Tanabe | H05H 7/18 313/360.1 |
| 5,412,283 | A * | 5/1995 | Tronc | H05H 9/02 313/359.1 |
| 5,814,821 | A * | 9/1998 | Reusch | G01N 23/046 250/492.3 |
| 2003/0202546 | A1* | 10/2003 | Hartemann | G03F 7/70008 372/5 |
| 2015/0366046 | A1* | 12/2015 | Wang | H05H 9/044 315/504 |

* cited by examiner

*Primary Examiner* — Tung X Le
*Assistant Examiner* — Henry Luong
(74) *Attorney, Agent, or Firm* — Elizabeth Kim Patent Law Offices LLC

(57) ABSTRACT

An electron acceleration system includes a first RF cavity, and a second RF cavity whose center is located at a distance not more than 1.5 inch from the center of the first RF cavity, along an axis. The first RF cavity has a length less than about 0.25 inches. The on-axis coupling between the first and second RF cavities along the axis, which is primarily electric, is cancelled out by an off-axis coupling between the RF cavities off the axis, which is primarily magnetic. In this way, the net RF coupling between the RF cavities is zero. The phase and amplitude of the first and second RF cavities are each independently adjustable.

14 Claims, 4 Drawing Sheets

COUPLING CANCELLATION IN ELECTRON ACCELERATION SYSTEMS

BACKGROUND

A widely used design for thermionic electron sources includes a plurality of RF acceleration structures, for example RF cavities. Thermionic electron sources, such as RF guns, are capable of providing high current electron beams and excellent emittance properties.

One limitation of RF electron sources that employ thermionic emitters is the heating of the emitter that occurs due to back-bombardment. When thermionic emitters are used with RF structures, there is a general incompatibility between the timing of a nominally DC emitter with the rapid varying temporal properties of the RF structure. One of the primary consequences is that, unless carefully designed, the energy of electrons that are directed back at the cathode can produce significant cathode heating due to this back-bombardment of the electrons.

As the pulse width, duty factor, and RF electric field of the extraction cavity are increased, the above-described cathode heating can quickly provide more cathode heating than the heater control. This results in both cathode damage, which can reduce lifetime, and control instability, which can disrupt the electron beam.

BRIEF DESCRIPTION OF THE DRAWINGS

The drawings disclose illustrative embodiments. They do not set forth all embodiments. Other embodiments may be used in addition or instead. Details that may be apparent or unnecessary may be omitted to save space or for more effective illustration. When the same numeral appears in different drawings, it refers to the same or like components or steps.

DETAILED DESCRIPTION

The present application describes systems and methods relating to electron acceleration systems that achieve coupling cancellation between adjacent cavities (also referred to as cells). In some embodiments, improved performance is achieved for thermionic electron sources by increasing back-bombardment suppression in these electron sources.

In the present application, the terms "cavity" and "cell" have the same meaning, and are used interchangeably.

In overview, independent phase and amplitude control is achieved between an initial reduced-length cell and a subsequent acceleration structure (having one or more cells) that is placed close to the initial cell, through coupling cancellation. In some embodiments, an on-axis electric coupling between the first cell and the subsequent cells is canceled by an off-axis magnetic coupling between the cells, so as to reduce the net coupling between them to zero. This allows the cells to become independent oscillators whose amplitude and phase can each be independently adjusted.

Illustrative embodiments are now discussed. Other embodiments may be used in addition or instead.

Figure 1:
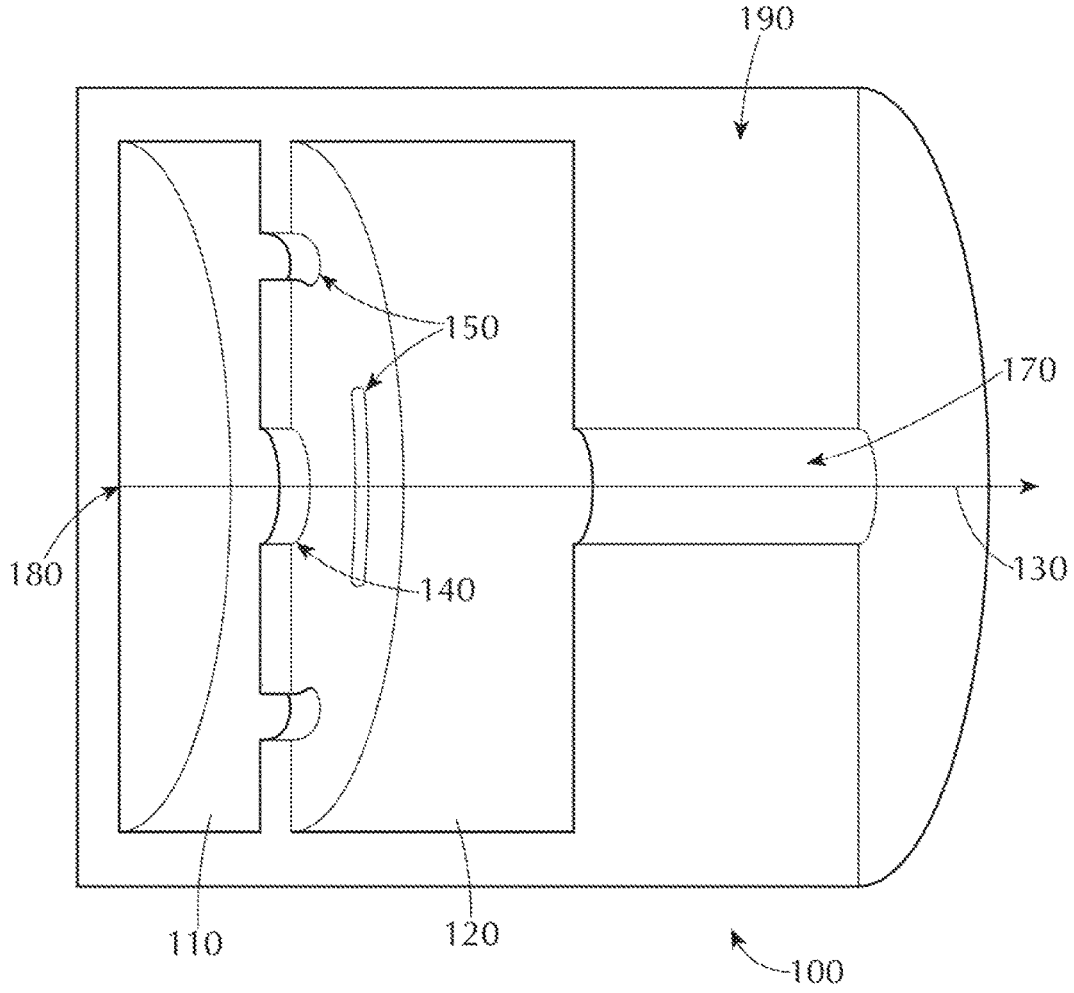
FIG. 1 illustrates a schematic diagram of a thermionic RF gun in which coupling cancellation is achieved between a first cell and a second cell, thereby suppressing back bombardment, in accordance with one embodiment of the present disclosure.

FIG. 1 illustrates a schematic diagram of a system 100 in accordance with one or more embodiments of the present disclosure. In some embodiments, the system 100 may be a thermionic RF gun, although other types of electron acceleration systems are also included within the scope of the present application.

In overview, the system 100 includes a first RF cavity 110 and a second RF cavity 120. In the illustrated embodiment, the center of the first RF cavity 110 is located at a distance not more than 1.5 inch from the center of the second RF cavity 120, along an axis 130. In other embodiments, the distance between the centers of the two cavities may have other values, including distances not more than 2.0 inches, 1.9 inches, 1.8 inches, 1.75 inches, 1.4 inches, 1.25 inches, and 1.0 inches.

In the embodiment illustrated in FIG. 1, the coupling between the first RF cavity 110 and the second RF cavity 120 through an on-axis iris 140 along the axis 130 is primarily electric. In the illustrated embodiment, the coupling between the first and second RF cavities through off-axis coupling slots 150 that are located off the axis 130 is primarily magnetic. The first 110 and second 120 RF cavities are connected through the iris 140.

A cathode electron source 180 generates electrons that form an electron beam that accelerates along the axis 130. The electron beam exits the system 100 through a beam pipe 170. In the illustrated embodiment, the cathode 180 is a thermionic cathode configured to generate electrons for entry into the first RF cavity through an input port. Cathodes other than thermionic cathodes are also within the scope of the present application.

The system 100 is made of a metal material 190, for example copper. Other metal materials known in the art may also be used to form the system 100.

The system 100 includes a number of aspects to its design. A first aspect is the reduction of electron back-bombardment onto the cathode 180 by reducing the length of the initial cell 110. In some embodiments, the length of the initial cell 110 is reduced to less than 0.25 inches, although other embodiments may include an initial cell 110 with other lengths, including lengths less than 0.2 inches, 0.15 inches, 0.1 inches, and 0.05 inches.

The effect of shortening the initial cell 110 is to increase the phase window where emission occurs and subsequently decrease the range of launch phase where back-bombardment occurs. In this description, phase refers to the phase of the RF cycle when the electron leaves the cathode. While back-bombardment is not completely eliminated, the back-bombardment on the cathode is reduced, and the net heating of the cathode 180 as a result of the back-bombardment is in turn reduced. In this way, the operation of the cavity becomes more stable.

In some embodiments, the thermionic RF gun 100 may be an S-band thermionic RF gun. In some embodiments, the capture percentage of electrons emitted from the thermionic RF gun 100 is greater than 50 percent.

Figure 2A:
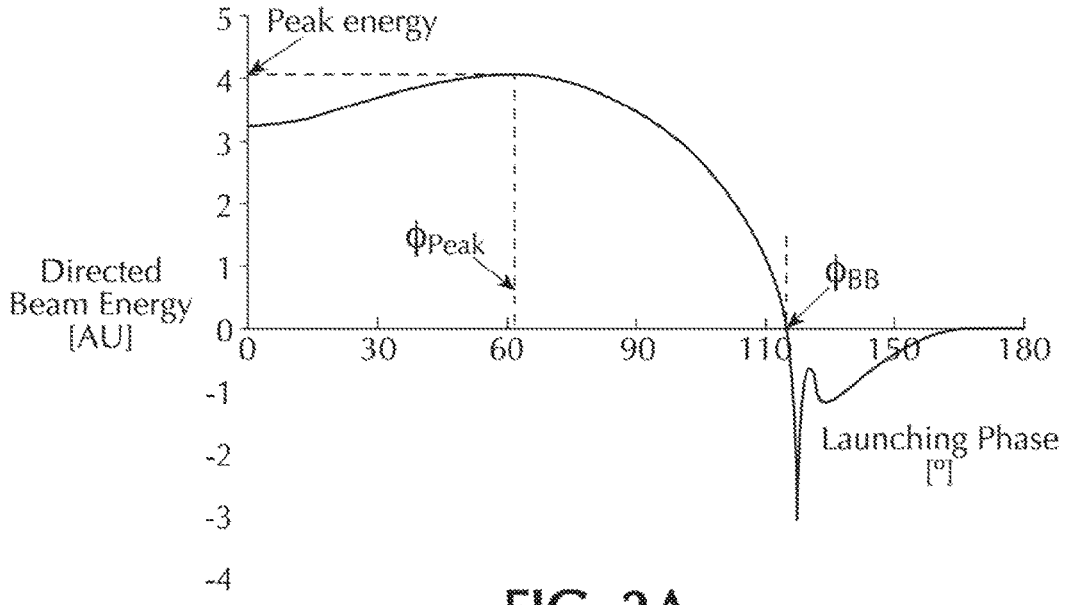
FIGS. 2A and 2B illustrate the directed energy of a beam particle after interacting with a RF cavity with a standard length (FIG. 2A) and a reduced length (FIG. 2B), respectively.
Figure 2B:
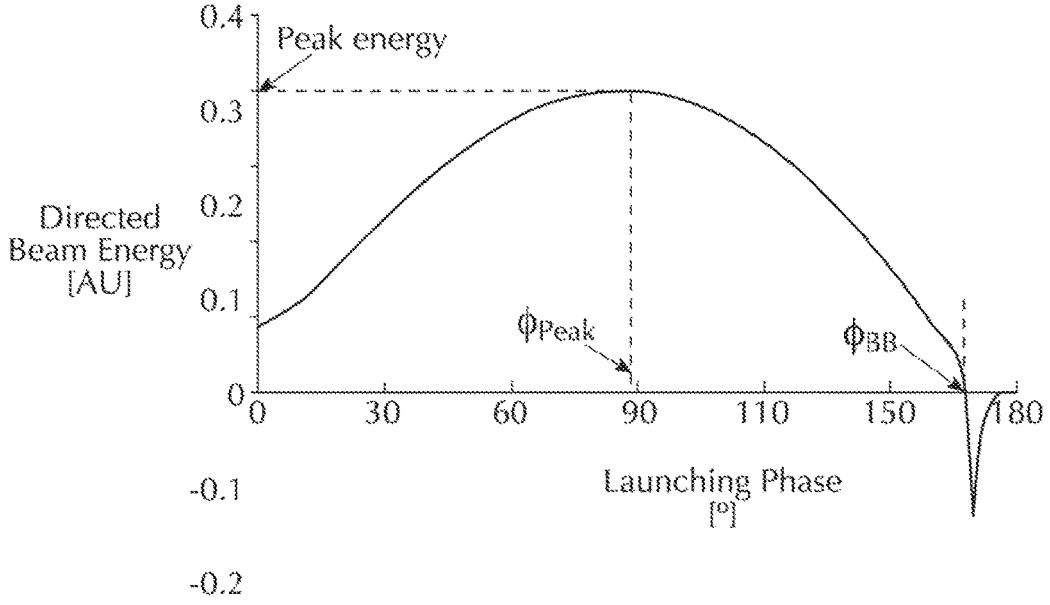

FIGS. 2A and 2B illustrate the directed beam energy as a function of initial electron launch phase, for two different lengths of the initial RF cavity. These figures show the directed energy of a beam particle after interacting with an RF cavity with a standard length (FIG. 2A), and a reduced length (FIG. 2B), respectively. The effect of the short first cell is to increase the launch phase ($\phi_{Peak}$) resulting in peak energy and increase the launch phase ($\phi_{BB}$) at which the back-bombardment onset occurs.

In the short cell example shown in FIG. 2B, the launch phase $\phi_{BB}$ past which the particles turn around and hit the cathode is pushed later in phase, and therefore back-bombardment power is reduced. If the second cell can be phased in such a way as to efficiently capture the beam accelerated by the first cavity, the ratio of the forward beam to the back-bombardment power can be increased, and hence, the overall performance envelope of the device can be improved.

As shown in FIGS. 2A and 2B, in a thermionic RF gun that includes a plurality of RF cavities, a shortened length for the first RF cavity improves thermionic cathode performance by reducing electron back bombardment powers on the cathode. In some embodiments, the reduction in electron back bombardment power is around a factor of 4, based on baseline studies.

A second feature of the thermionic RF gun 100 is the ability to closely space the first and second RF cavities, while being able to adjust the phase and amplitude of the accelerating fields in the second cavity independently of the first by way of an RF coupling cancellation between the two cavities. A closely spaced second RF cavity, or set of RF cavities subsequent to the first RF cavity, improves the capture efficiency of the system 100. Because subsequent cells are placed close to the short initial cell, the increased electron capture by the first cell can be fully taken advantage of, as described above in conjunction with FIGS. 2A and 2B.

A standing-wave accelerator does not have the freedom to adjust the phase and amplitude of its constituent cells, as all cells are required to be in phase or 180° out of phase with one another. In the thermionic RF gun 100, however, the two RF cavities 110 and 120 are closely spaced to one another and the coupling is canceled by balancing the on-axis electric coupling with off-axis magnetic coupling, as further described below.

A third aspect of the design for system 100 is the decoupling of the first and second cells 110 and 120 by balancing the electric and magnetic coupling between the cells, so as to reduce the net RF coupling between the cells to zero. In the illustrated embodiment, the on-axis coupling between the first and second RF cavities along the axis 130, which is primarily electric, is cancelled out by an off-axis coupling between the RF cavities off the axis 130, which is primarily magnetic. As a result, the net RF coupling between the RF cavities becomes zero. In this way, the cells are decoupled, and the phase and amplitude of the first and second RF cavities are each independently adjustable. This decoupling allows for an arbitrary phase difference between the first and second cell at the cost of dual RF feeds.

Figure 3A:
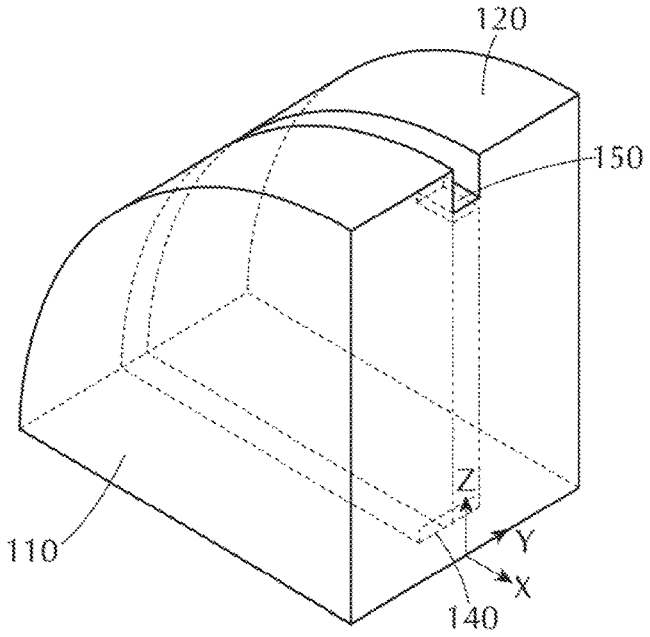
FIG. 3A illustrates a computer model of a two-cell accelerating structure, including two RF cavities that are electrically coupled through an on-axis iris and magnetically coupled through an off-axis coupling slot.
Figure 3B:
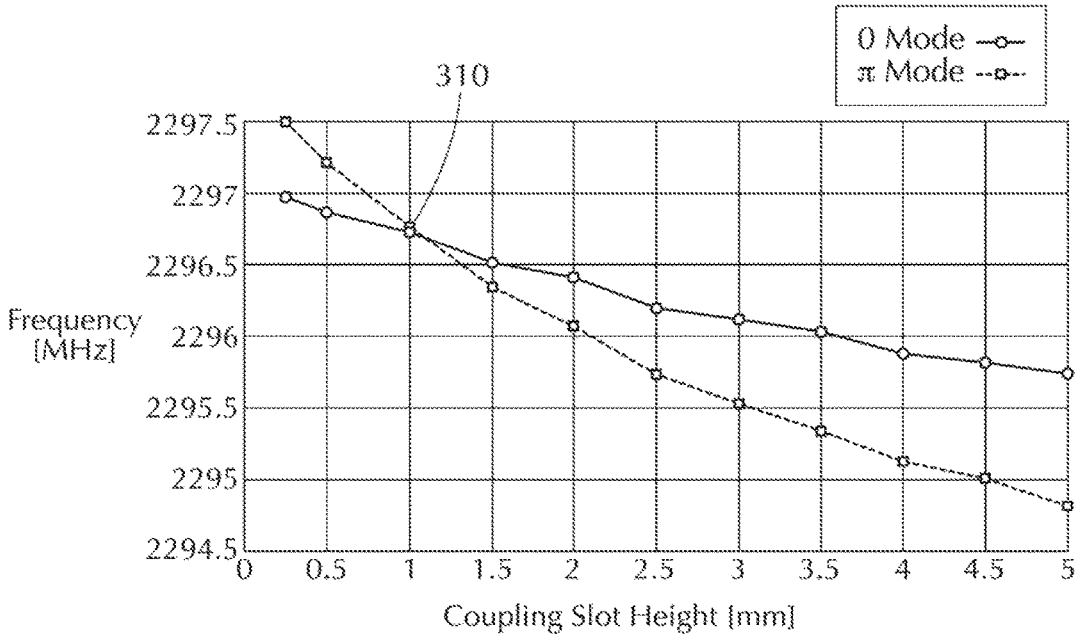
FIG. 3B illustrates the two resonant frequencies of the $TM_{010}$ modes in a coupled two-cavity system as a function of magnetic coupling slot height.

FIG. 3A illustrates a HFSS (high frequency structural simulator) model of a two-cell accelerating structure including a first RF cavity 110 and a second RF cavity 120 that are electrically coupled through an on-axis iris 140 and magnetically coupled through an off-axis coupling slot 150. FIG. 3B illustrates the two resonant frequencies of the $TM_{010}$ modes in a coupled two-cavity system as a function of magnetic coupling slot height.

In the embodiments illustrated in FIGS. 3A and 3B, a cancellation between the on-axis electric field coupling from the beam pipe with the off-axis magnetic field coupling is achieved by one or more magnetic coupling slots 150 located closer to the outer diameter of the cavity. FIG. 3A shows a one-quarter HFSS model of two identical pillbox cavities that are coupled both on-axis by an iris 140 and off axis by a magnetic coupling slot 150. While one slot is shown in the one-quarter model of FIG. 3A, there are two or more slots total in the full geometry of an actual RF gun. The HFSS model shown in FIG. 3A was used as a proof-of-concept to show the canceling of the coupling between the cavities.

For small coupling slot heights, the net coupling is predominantly electric, though the iris and the lower frequency mode is identified as the 0-mode of the two-oscillator system. The higher frequency corresponds to the x-mode. As can be seen in FIG. 3B, as the height of the magnetic coupling slot is increased, the mode separation decreases. This occurs because the magnetic coupling acts in an opposite fashion to the on-axis electric coupling.

At large coupling slot heights, the magnetic coupling dominates the electric coupling and the lower frequency is now identified as corresponding to the π-mode of the two-oscillator system. As shown in FIG. 3B, as the slot height increases, thus increasing the magnetic coupling, there is a crossing point 310 where no net coupling occurs. At this value of the coupling slot height, the 0-mode frequency curve and x-mode frequency curve will intersect and the frequencies will be equal, assuming that they have the same natural frequency, namely the frequency before any holes were cut in the wall separating them. The two oscillator system will then have no net coupling, making them independent oscillators.

Studies conducted with both eigenvalue and S-parameter methods have confirmed the coupling cancellation scheme described in FIGS. 3A-3B above. This scheme was first studied using a simplified pillbox model, then applied to the full device RF model that included input waveguides.

The ability to create two independent oscillators that are connected by a short beam pipe, which ordinarily would provide coupling between the oscillators, is a key feature that allows the RF gun to operate according to the design features described above. Studies have shown that presenting input power to each one of the two waveguides results in the filling of only the cavity directly connected to that waveguide. In some studies, a −25 dB separation was found between the two waveguides, showing that coupling separation had been achieved with very little cross-coupling of the cell fields from the uncoupled waveguide.

The creation of two independent cavities may require two independent RF coupling ports to the different sections of the gun. In some embodiments, an S-Band waveguide based variable power splitter may be used.

In some embodiments, the thermionic electron gun operates at 2856 MHz, and has a usable exit beam energy greater than 2.5 MeV. The thermionic electron gun has a 1 A pulse average current, and an emittance of 5-10π mm mrad. The klystron power is 5 MW. In some embodiments, the reduction of electron back bombardment power on the cathode is about a factor of 4.

In some embodiments, the thermionic RF gun disclosed in this application can be used as a continuously operating pulsed electron source for synchrotron light sources. In some embodiments, the electron back-bombardment power on the thermionic RF gun is about 50 kW when operated continuously. In addition, the above-described thermionic RF gun with shortened initial cell could be used in any accelerator facility that does not have electron beam requirements that specifically require the use of a photoinjector, including without limitation terahertz light sources.

Figure 4:
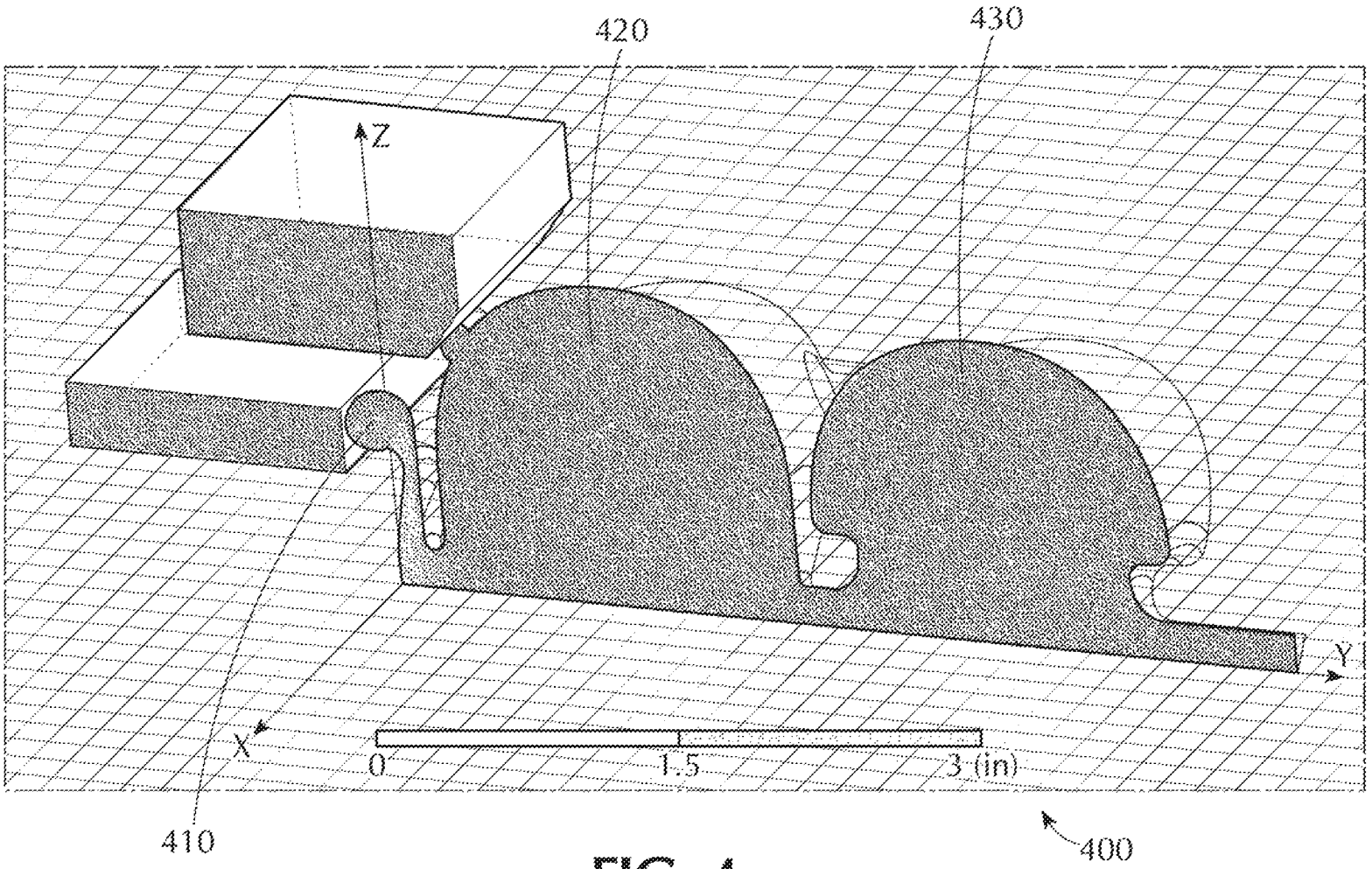
FIG. 4 illustrates a three-cell configuration, for an electron acceleration system in accordance with one or more embodiments of the present application.

In some embodiments of the present application, three or more cells or RF cavities can be included in the thermionic RF gun. FIG. 4 illustrates a three-cell configuration, for a thermionic RF gun in accordance with one or more embodiments of the present application. In the illustrated embodiment that includes three cells, the thermionic RF gun includes a first RF cavity 410, a second RF cavity 420, and a third RF cavity 430. In this embodiment, the second cell 420 and the third cell 430 are driven in the a mode for purposes of RF power efficiency. In embodiments that include more than three cells, all cells other than the first cell may likewise be driven in the $\pi$ mode for increased efficiency.

In some embodiments of the present application, the second RF cavity may be placed so that its center is at a distance less that about 1.5 inches from the center of the first RF cavity along an axis, as shown in FIG. 4. In other embodiments, the distance between the centers of the two cavities may have other values, including distances less than 2.0 inches, 1.9 inches, 1.8 inches, 1.75 inches, 1.4 inches, 1.25 inches, and 1.0 inches.

In some embodiments, the 3-cell thermionic RF gun may be equipped with a focusing solenoid. In some embodiments, the beam parameters for such an RF gun may include: a 1 amp average current during the RF pulse, less than 10 mm-rad RMS normalized emittance, and greater than 2.5 MeV energy.

In some embodiments of the present application, a method may include providing a first RF cavity having a length less than 0.25 inches, then disposing a second RF cavity so that the center of the second cavity is located at a distance less than 1.5 inches from the center of the first RF cavity, along an axis. The method may further include cancelling out an on-axis electric coupling between the first and second RF cavities along the axis by an off-axis magnetic coupling between the RF cavities off the axis, so that the net RF coupling between the RF cavities is zero.

The method may further include controlling the amplitude and phase of the first RF cavity independently of the second RF cavity. The second and third RF cavity may be driven in the $\pi$ mode.

In other embodiments, the method may include disposing a second RF cavity so that the center of the second cavity is located at a distance having other values, including distances less than 2.0 inches, 1.9 inches, 1.8 inches, 1.75 inches, 1.4 inches, 1.25 inches, and 1.0 inches.

In sum, the present application describe systems and methods for coupling cancellation between adjacent cells in an electron acceleration system. In some embodiments, such coupling cancellation can reduce electron back bombardment in a thermionic RF gun, thus improving its performance. Decreasing the heat load caused by electrons back bombarding on the cathode will allow for increased duty factor in the operation of the gun, and results in a higher average current.

In some embodiments, the coupling cancellation systems and methods disclosed in the present application may be used in a standing wave linear accelerator that includes many cells that are uncoupled and independently driven. This allows for greater flexibility in operating the device, in particular, phase tuning the RF oscillations from cavity to cavity as the accelerated particles move from cavity to cavity.

In some embodiments, the thermionic electron source disclosed in this application can be used in linear accelerators, once the operational duty factor is increased to about 10% or so. These linear accelerators may be used for environmental purposes, including without limitation sludge treatment, medical waste processing, and soil contamination remediation.

The components, steps, features, objects, benefits and advantages that have been discussed are merely illustrative. None of them, nor the discussions relating to them, are intended to limit the scope of protection in any way. Numerous other embodiments are also contemplated, including embodiments that have fewer, additional, and/or different components, steps, features, objects, benefits and advantages. The components and steps may also be arranged and ordered differently.

Nothing that has been stated or illustrated is intended to cause a dedication of any component, step, feature, object, benefit, advantage, or equivalent to the public. While the specification describes particular embodiments of the present disclosure, those of ordinary skill can devise variations of the present disclosure without departing from the inventive concepts disclosed in the disclosure. While certain embodiments have been described of systems and methods relating to electron acceleration systems, it is to be understood that the concepts implicit in these embodiments may be used in other embodiments as well. In the present disclosure, reference to an element in the singular is not intended to mean "one and only one" unless specifically so stated, but rather "one or more." All structural and functional equivalents to the elements of the various embodiments described throughout this disclosure, known or later come to be known to those of ordinary skill in the art, are expressly incorporated herein by reference.

What is claimed is:

1. A thermionic RF gun, comprising:

a first RF cavity;

a second RP cavity connected to the first RF cavity along an axis;

a thermionic cathode configured to generate electrons for entry into the first RF cavity; and a dual RF feed configured to provide input power to each of the first and second RF cavities independently, so as to generate an RF field in each of the first and second RF cavities;

wherein a length of the first RF cavity is less than 0.25 inches so as increase a launch phase $\phi_{BB}$ at which back-bombardment occurs, thereby reducing an electron back-bombardment power of the thermionic RF gun;

wherein a center of the second RF cavity is located at a distance not more than 1.5 inches from a center of the first RF cavity, along the axis, thereby increasing an electron capture rate of the thermionic RF gun;

and wherein an electric coupling between the first and second RF cavities is cancelled out by a magnetic coupling between the first and second RF cavities, so that a phase of the RF field in the first RF cavity is controllable independently of a phase of the RF field in the second RF cavity.

2. The thermionic RF gun of claim 1, wherein a coupling between the first and second RF cavity through an on-axis iris along the axis is primarily electric.

3. The thermionic RF gun of claim 1, wherein a coupling between the first and second RF cavities through one or more off-axis coupling slots off the axis is primarily magnetic.

4. The thermionic RF gun of claim 3, wherein an RF coupling cancellation is achieved by adjusting a height of each of the one or more off-axis coupling slots until the net RE coupling between the first and the second RF cavities becomes zero.

5. The thermionic RE gun of claim 1, wherein a capture percentage of electrons emitted from the thermionic RF gun is greater than 50 percent.

6. The thermionic RF gun of claim 1, wherein the thermionic RF gun is an S-band thermionic RF gun.

7. The thermionic RF gun of claim 1, further comprising a third RF cavity; wherein an amplitude and a phase of an RF field in the third RF cavity are adjustable independently of the RF fields in the first and second RF cavities.

8. The thermionic RF gun of claim 1, further comprising a plurality of RF cavities; and wherein an amplitude and a phase of each one of the plurality of RF cavities is independently adjustable with respect to one another.

9. The thermionic RF gun of claim 1, wherein the thermionic RF gun has an operation frequency of about 2856 MHz, and has a usable exit beam greater than 2.5 MeV.

10. The thermionic RF gun of claim 9, wherein the thermionic RF gun has a pulse average current of about 1 A, and an emittance between about 5 $\pi$ and 10 $\pi$ mm-mrad.

11. The thermionic RF gun of claim 1, wherein the electron back-bombardment power on the thermionic electron gun is about 50 kW when operated continuously.

12. The thermionic of claim 1, wherein the distal between the center of the first cavity and the center of the second RF cavity along the axis is no more than 2.0 inches, 1.9 inches, 1.8 inches, 1.75 inches, 1.4 inches, 1.25 inches, and 1.0 inches.

13. The thermionic RF gun of claim 1, wherein an amplitude of the RF field in the first RF cavity is controllable independently of an amplitude of the RF field in the second RF cavity.

14. The thermionic RF gun of claim 1, wherein the electric coupling between the first and second RF cavities is an on-axis electric coupling along the axis, and wherein a magnetic coupling between the first and second RF cavities is an off-axis magnetic coupling off the axis.

* * * * *